US005964480A

United States Patent [19]

Chen

[11] Patent Number: 5,964,480

[45] Date of Patent: Oct. 12, 1999

[54] DOCUMENT FOLDER ASSEMBLY

[76] Inventor: Cheng-Sung Chen, No. 380, Chung-Hua Rd., Tou-Liu City, Yun-Lin Hsien, Taiwan

[21] Appl. No.: 09/058,154

[22] Filed: Apr. 10, 1998

[30] Foreign Application Priority Data

Apr. 25, 1997 [TW] Taiwan ..... 86206616

[51] Int. Cl.[6] ..... B42F 9/00

[52] U.S. Cl. ..... 281/15.1; 281/28; 281/23; 281/46; 281/47; 281/45; 402/60; 24/67.7; 24/67.11; 24/67 R

[58] Field of Search ..... 281/15.1, 28, 23, 281/46, 47, 45; 402/60; 24/67.7, 67.11, 67 R

[56] References Cited

U.S. PATENT DOCUMENTS

| | | | |
|---|---|---|---|
| 5,413,430 | 5/1995 | Schrem et al. | 402/60 |
| 5,765,873 | 6/1998 | Chen | 402/60 |

FOREIGN PATENT DOCUMENTS

| | | |
|---|---|---|
| 0 609 568 | 8/1994 | European Pat. Off. . |
| 2 448 443 | 9/1980 | France . |
| 1 245 904 | 8/1967 | Germany . |
| 89 09 998 | 12/1989 | Germany . |
| 42 20 406 | 12/1993 | Germany . |
| 61-23426 | 7/1985 | Japan . |

*Primary Examiner*—Willmon Fridie, Jr.
*Assistant Examiner*—Mark T. Henderson
*Attorney, Agent, or Firm*—Foley & Lardner

[57] ABSTRACT

A document folder assembly includes a folder unit which has a front sheet portion, a back sheet portion, and a hinge portion for hinging together adjacent edge sections of the front and back sheet portions. The front and back sheet portions are adapted to receive documents therebetween such that one edge of the documents extends into the hinge portion. A clip member has a front clip portion, a rear clip portion, and a connecting portion interconnecting the front and rear clip portions. The front and rear clip portions cooperatively confine a clamping space for clamping the folder unit at the hinge portion. The clip member is mounted pivotally on the folder unit, and is movable between a first position in which the hinge portion is clamped between the front and rear clip portions in order to retain the documents in the folder unit, and a second position in which the hinge portion is released from the clip member in order to permit removal of the documents in the folder unit.

8 Claims, 3 Drawing Sheets

DOCUMENT FOLDER ASSEMBLY

BACKGROUND OF THE INVENTION

1. Field of the Invention

The present invention relates to a document folder assembly, more particularly to a document folder assembly which is relatively convenient to use and which facilitates hanging or binding of documents retained therein in a standard document binder without the need for punching binding holes in the documents.

2. Description of the Related Art

German Patent No. DE-AS-1245904, French Patent No. 7903354, Japanese Laid-Open Publication No. 61-23426, and European Patent No. 0609568 disclose conventional clip members for use with a folder unit having a front sheet portion, a back sheet portion, and a hinge portion that hinges together adjacent edge sections of the front and back sheet portions. The front and back sheet portions can receive documents therebetween such that one edge of the documents extends into the hinge portion. The conventional clip members have a front clip portion, a rear clip portion, and a connecting portion interconnecting the front and rear clip portions. The front and rear clip portions cooperatively confine a clamping space that permits clamping of the folder unit at the hinge portion. The conventional clip members can be mounted pivotally on the folder unit, and are movable between a first position in which the hinge portion of the folder unit is clamped between the front and rear clip portions of the clip member in order to retain the documents in the folder unit, and a second position in which the hinge portion of the folder unit is released from the clip member in order to permit removal of the documents in the folder unit.

However, it is noted that the conventional clip members do not permit mounting of the folder unit on a standard ring binder. Furthermore, turning of the front sheet portion away from the back sheet portion for opening the folder unit is not permitted by the conventional clip members unless the latter are in the second position. Moreover, the conventional clip members are not configured to facilitate insertion of the hinge portion of the folder unit into the clamping space when the clip members are moved from the second position to the first position.

German Patent No. DE 4220406 and German Utility Model No. 8909998.2 disclose document clip members. However, the clip members disclosed therein are not designed for mounting pivotally on a folder unit, and are not capable of overcoming the drawbacks mentioned beforehand.

SUMMARY OF THE INVENTION

The main object of the present invention is to provide a document folder assembly which is convenient to use and which permits hanging of the documents or binding of the documents retained therein in a standard ring binder without damaging the appearance of the documents.

Another object of the present invention is to provide a document folder assembly which permits opening of the folder unit without the need to move the clip member to a releasing position.

A further object of the present invention is to provide a document folder assembly which facilitates movement of the clip member from the releasing position to a clamping position.

Accordingly, the document folder assembly of the present invention includes a folder unit and a clip member. The folder unit has a front sheet portion, a back sheet portion, and a hinge portion for hinging together adjacent edge sections of the front and back sheet portions. The front and back sheet portions are adapted to receive documents therebetween such that one edge of the documents extends into the hinge portion. The clip member has a front clip portion, a rear clip portion, and a connecting portion interconnecting the front and rear clip portions. The front and rear clip portions cooperatively confine a clamping space for clamping the folder unit at the hinge portion. The clip member is mounted pivotally on the folder unit, and is movable between a first position in which the hinge portion of said folder unit is clamped between the front and rear clip portions of the clip member in order to retain the documents in the folder unit, and a second position in which the hinge portion of the folder unit is released from the clip member in order to permit removal of the documents in the folder unit.

The hinge portion is formed with a binding extension which has binding holes that are adapted for mounting the document folder assembly on a standard ring binder. The front sheet portion is formed with a groove to be located around the front clip portion of the clip member in order to facilitate turning of the front sheet portion away from the back sheet portion for opening the folder unit when the clip member is in the first position. The front clip portion has a bent corner which bends away from the clamping space to form a guiding portion that facilitates insertion of the hinge portion into the clamping space when the clip member is moved from the second position to the first position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
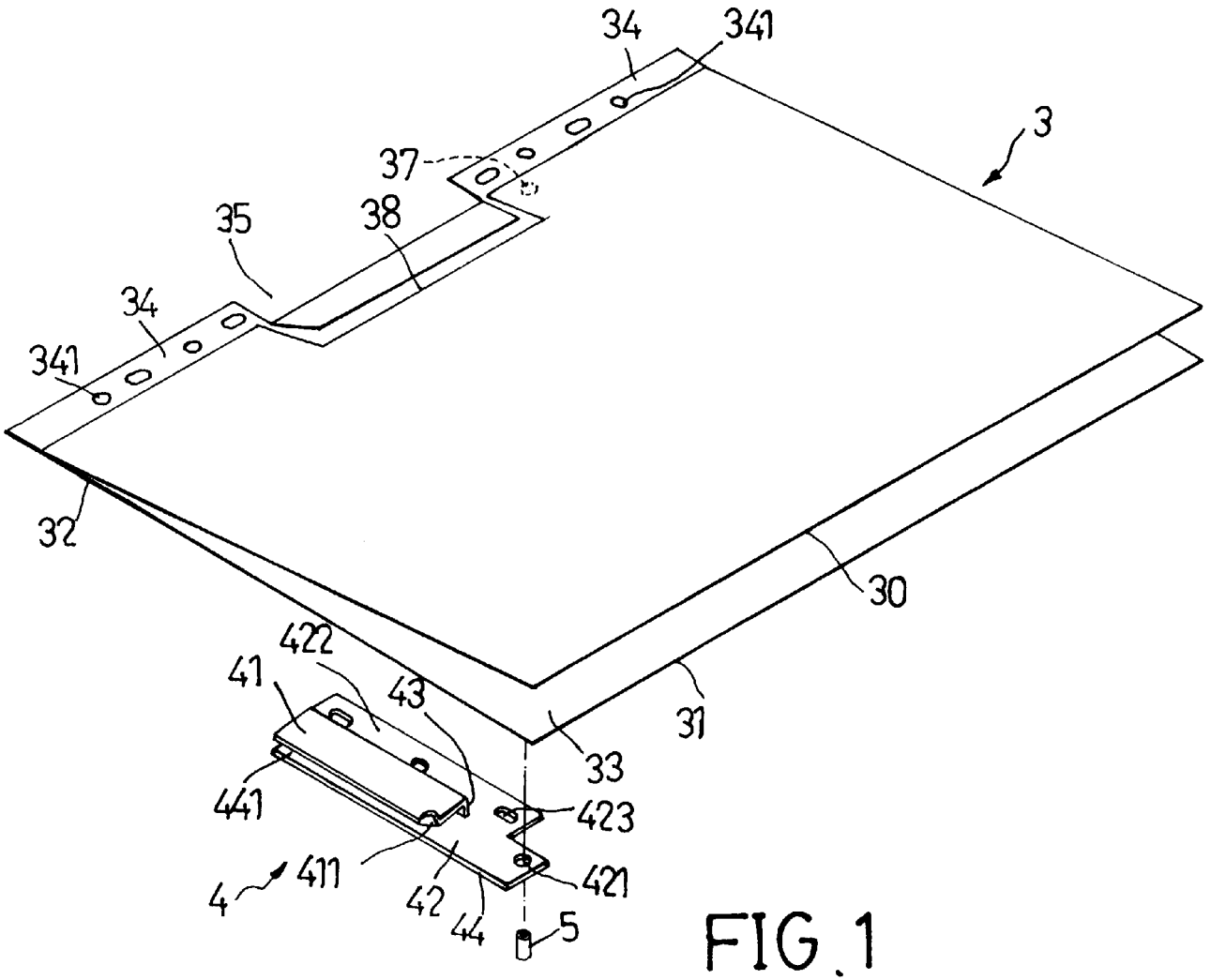
FIG. 1 is an exploded perspective view illustrating a document folder assembly according to a preferred embodiment of the present invention.
Figure 2:
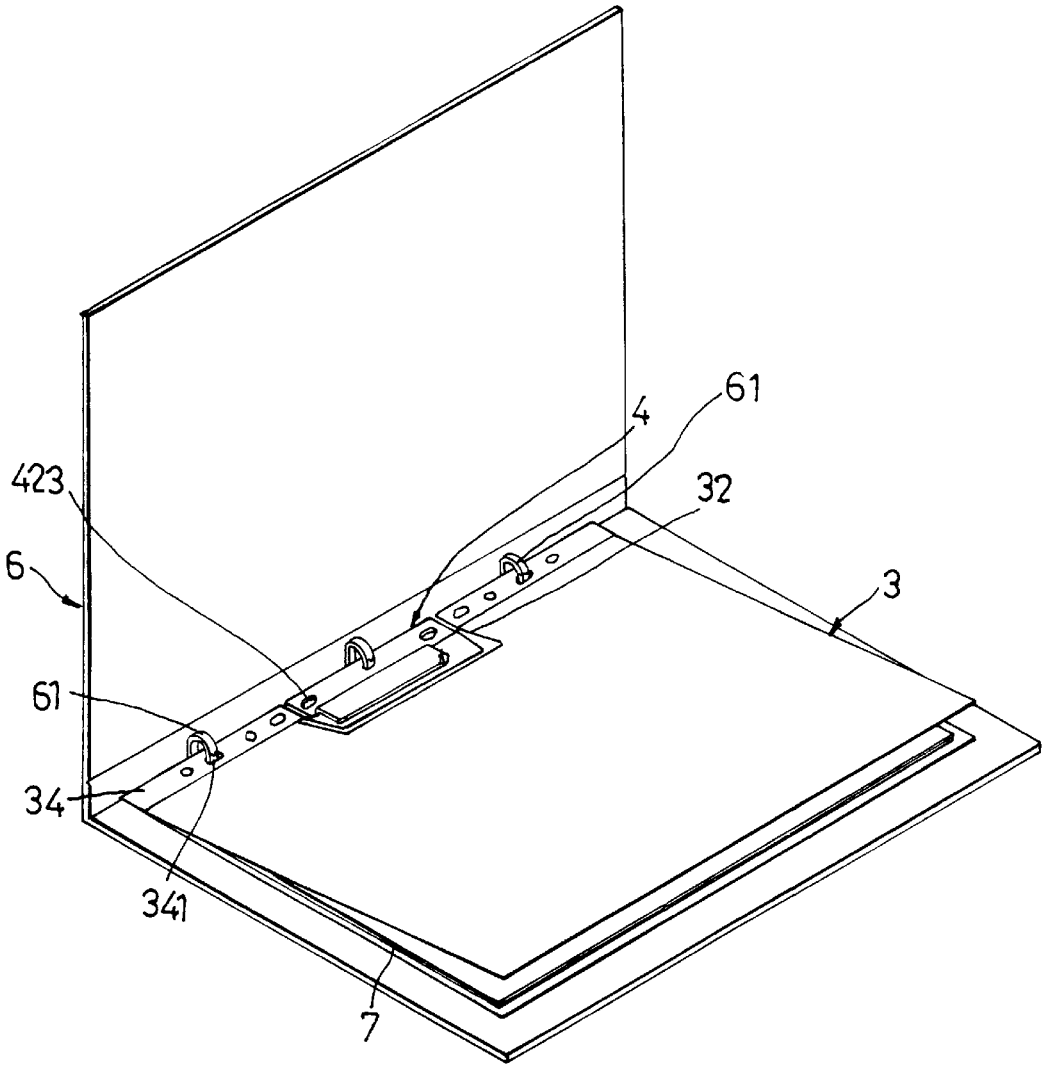
FIG. 2 is a schematic view illustrating the document folder assembly of the preferred embodiment when mounted on a standard ring binder.

Referring to FIGS. 1 and 2, the document folder assembly according to the preferred embodiment of the present invention is shown to include a folder unit 3 and a clip member 4.

The folder unit 3 has a front sheet portion 30, a back sheet portion 31, and a hinge portion 32 for hinging together adjacent longitudinal edge sections of the front and back sheet portions 30, 31. The front and back sheet portions 30, 31 are adapted to receive documents 7 therebetween through an access 33 formed between the front and back sheet portions 30, 31 such that one edge of the documents 7 extends into the hinge portion 32. The hinge portion 32 is formed with a first binding extension 34 having a plurality of first binding holes 341. The first binding holes 341 may be circular or oval in shape, or may include alternately arranged circular-shaped and oval-shaped ones as in the present embodiment. Each of the first binding holes 341 is adapted to permit extension of a ring 61 of a standard ring binder 6 therethrough for mounting the document folder assembly on the ring binder 6, as shown in FIG. 2. The first binding extension 34 has a notch 35 which divides the first binding extension 34 into two spaced sections. The front sheet portion 30 is formed with a groove 38 adjacent to the notch 35 and the hinge portion 32. The back sheet portion 31 is formed with a first pivot hole 37 at the hinge portion 32.

The clip member 4 has a front clip portion 41, a rear clip portion 42, and a connecting portion 43 which interconnects the front and rear clip portions 41, 42. The front and rear clip portions 41, 42 cooperatively confine a clamping space 441 for clamping the folder unit 3 at the hinge portion 32. The front clip portion 41 has a length shorter than that of the notch 35. The rear clip portion 42 is longer than the front clip portion 41 so as to form a mounting tab 44 which projects relative to the front clip portion 41 and which is formed with a second pivot hole 421 aligned with the first pivot hole 37 in the back sheet portion 31 of the folder unit 3. The first and second pivot holes 37, 421 permit extension of a pivot 5, such as a rivet, therethrough so as to mount pivotally the clip member 4 on the hinge portion 32 of the folder unit 3, thereby permitting movement of the clip member 4 between a first position in which the hinge portion 32 of the folder unit 3 is clamped between the front and rear clip portions 41, 42 of the clip member 4 in order to retain the documents 7 in the folder unit 3, and a second position in which the hinge portion 32 of the folder unit 3 is released from the clip member 4 in order to permit removal of the documents 7 in the folder unit 3. The clip member 4 is further formed with a second binding extension 422 which has substantially the same width as the first binding extension 34 and which is formed with a plurality of spaced second binding holes 423 that are aligned with the first binding holes 341 in the first binding extension 34. Similarly, the second binding holes 423 are adapted to permit extension of the rings 61 of the standard ring binder 6 therethrough for mounting the clip member 4 on the ring binder 6. The front clip portion 41 of the clip member 4 has a bent corner which bends away from the clamping space 441 to form a guiding portion 411, thereby facilitating insertion of the hinge portion 32 of the folder unit 3 into the clamping space 441 when the clip member 4 is moved from the second position to the first position for clamping the folder unit 3.

To use the document folder assembly of this embodiment, documents 7 are inserted between the front and back sheet portions 30, 31 through the access 33 so that the documents 7 extend into the hinge portion 32. The clip member 4 is then moved pivotally from the second position to the first position to clamp the hinge portion 32 of the folder unit 3. The guiding portion 411 formed on the front clip portion 41 facilitates insertion of the hinge portion 32 of the folder unit 3 into the clamping space 441. Moreover, the notch 35 enables the clip member 4 to clamp the hinge portion 32 of the folder unit 3 so as to retain the documents 7 in the folder unit 3. When the clip member 4 is moved to the first position, the groove 38 is located around the front clip portion 41 of the clip member 4 in order to facilitate turning of the front sheet portion 30 away from the back sheet portion 31 for opening the folder unit 3 to facilitate viewing of the documents 7 retained in the folder unit 3. To remove the documents 7 from the folder unit 3, the clip member 4 is moved in a reverse direction from the first position to the second position. Since the rear clip portion 42 is longer than the front clip portion 41, and since the second pivot hole 421 is formed in the mounting tab 44 of the clip member 4, the hinge portion 32 of the folder unit 3 can be completely released from the clamping space 441 of the clip member 4 when the clip member 4 is moved to the second position. The documents 7 can thus be removed from the folder unit 3 through the access 33 at this time.

Figure 3:
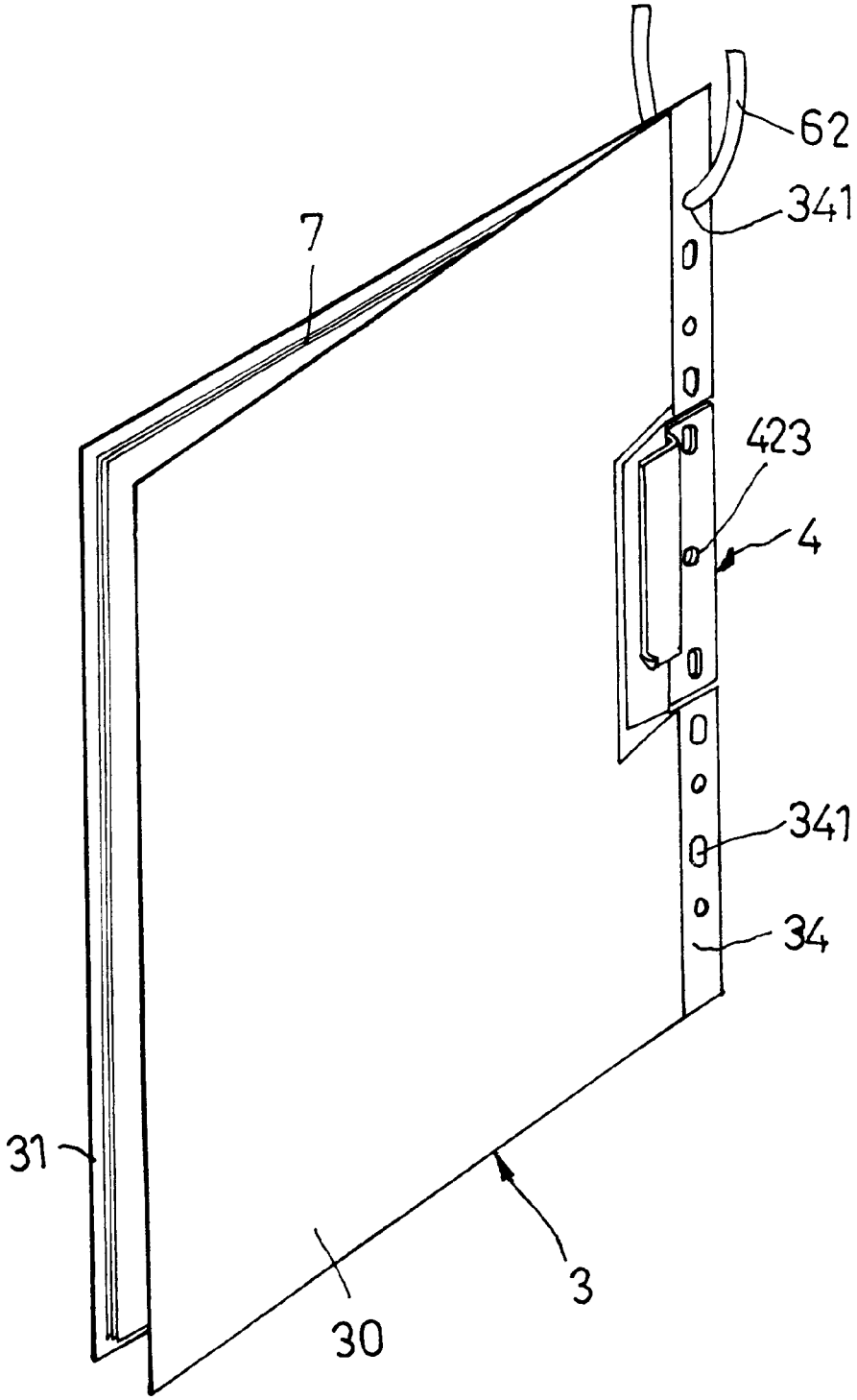
FIG. 3 is a schematic view illustrating the document folder assembly of the preferred embodiment when hung at a desired place for use.

As shown in FIG. 2, the document folder assembly with the documents 7 retained therein can be mounted on a standard ring binder 6 to organize the documents 7. As shown in FIG. 3, the document folder assembly can also be hung at a desired place with the use of a string 62.

It has thus been shown that the document folder assembly of the present invention is relatively convenient to use. Furthermore, the document folder assembly can be mounted on a standard ring binder without the need for punching binding holes in the documents. The appearance of the documents can therefore be maintained.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A document folder assembly comprising:

a folder unit which has a front sheet portion, a back sheet portion, and a hinge portion for hinging together adjacent edge sections of the front and back sheet portions, the front and back sheet portions being adapted to receive documents therebetween such that one edge of the documents extends into the hinge portion; and a clip member having a front clip portion, a rear clip portion, and a connecting portion interconnecting the front and rear clip portions, the front and rear clip portions cooperatively confining a clamping space for clamping the folder unit at the hinge portion, the clip member being mounted pivotally on the folder unit and being movable between a first position in which the hinge portion is clamped between the front and rear clip portions in order to retain the documents in the folder unit, and a second position in which the hinge portion is released from the clip member in order to permit removal of the documents in the folder unit;

the hinge portion being formed with a first binding extension which has first binding holes that are adapted for mounting the document folder assembly on a standard ring binder;

the front sheet portion being formed with a groove to be located around the front clip portion of the clip member in order to facilitate turning of the front sheet portion away from the back sheet portion for opening the folder unit when the clip member is in the first position;

the front clip portion having a bent corner which bends away from the clamping space to form a guiding portion that facilitates insertion of the hinge portion into the clamping space when the clip member is moved from the second position to the first position.

2. The document folder assembly according to claim 1, wherein the first binding extension has a notch to enable the clip member to clamp the hinge portion of the folder unit, the clip member being formed with a second binding extension which has a second binding hole adapted for mounting the clip member on the standard ring binder.

3. The document folder assembly according to claim 1, wherein the rear clip portion is longer than the front clip portion so as to form a mounting tab which projects relative to the front clip portion and which is mounted pivotally to the back sheet portion of the folder unit so that the hinge portion of the folder unit can be completely released from the clamping space of the clip member when the clip member is in the second position.

4. A document folder assembly comprising:

a folder unit which has a front sheet portion, a back sheet portion, and a hinge portion for hinging together adjacent edge sections of the front and back sheet portions, the front and back sheet portions being adapted to receive documents therebetween such that one edge of the documents extends into the hinge portion; and a clip member having a front clip portion, a rear clip portion, and a connecting portion interconnecting the front and rear clip portions, the front and rear clip portions cooperatively confining a clamping space for clamping the folder unit at the hinge portion, the clip member being mounted pivotally on the folder unit and being movable between a first position in which the hinge portion is clamped between the front and rear clip portions in order to retain the documents in the folder unit, and a second position in which the hinge portion is released from the clip member in order to permit removal of the documents in the folder unit;

the hinge portion being formed with a first binding extension which has first binding holes that are adapted for mounting the document folder assembly on a standard ring binder.

5. The document folder assembly according to claim 4, wherein the first binding extension has a notch to enable the clip member to clamp the hinge portion of the folder unit, the clip member being formed with a second binding extension which has a second binding hole adapted for mounting the clip member on the standard ring binder.

6. The document folder assembly according to claim 4, wherein the rear clip portion is longer than the front clip portion so as to form a mounting tab which projects relative to the front clip portion and which is mounted pivotally to the back sheet portion of the folder unit so that the hinge portion of the folder unit can be completely released from the clamping space of the clip member when the clip member is in the second position.

7. A document folder assembly comprising:

a folder unit which has a front sheet portion, a back sheet portion, and a hinge portion for hinging together adjacent edge sections of the front and back sheet portions, the front and back sheet portions being adapted to receive documents therebetween such that one edge of the documents extends into the hinge portion; and a clip member having a front clip portion, a rear clip portion, and a connecting portion interconnecting the front and rear clip portions, the front and rear clip portions cooperatively confining a clamping space for clamping the folder unit at the hinge portion, the clip member being mounted pivotally on the folder unit and being movable between a first position in which the hinge portion is clamped between the front and rear clip portions in order to retain the documents in the folder unit, and a second position in which the hinge portion is released from the clip member in order to permit removal of the documents in the folder unit;

the front sheet portion being formed with a groove to be located around the front clip portion of the clip member in order to facilitate turning of the front sheet portion away from the back sheet portion for opening the folder unit when the clip member is in the first position.

8. A document folder assembly comprising:

a folder unit which has a front sheet portion, a back sheet portion, and a hinge portion for hinging together adjacent edge sections of the front and back sheet portions, the front and back sheet portions being adapted to receive documents therebetween such that one edge of the documents extends into the hinge portion; and a clip member having a front clip portion, a rear clip portion, and a connecting portion interconnecting the front and rear clip portions, the front and rear clip portions cooperatively confining a clamping space for clamping the folder unit at the hinge portion, the clip member being mounted pivotally on the folder unit and being movable between a first position in which the hinge portion is clamped between the front and rear clip portions in order to retain the documents in the folder unit, and a second position in which the hinge portion is released from the clip member in order to permit removal of the documents in the folder unit;

the front clip portion having a bent corner which bends away from the clamping space to form a guiding portion that facilitates insertion of the hinge portion into the clamping space when the clip member is moved from the second position to the first position.

* * * * *